United States Patent [19]

Baur, Jr.

[11] 4,343,617

[45] Aug. 10, 1982

[54] SUTURE AND PROSTHESIS MATERIAL

[76] Inventor: Paul S. Baur, Jr., 208 Pecan Dr., League City, Tex. 77573

[21] Appl. No.: 243,871

[22] Filed: Mar. 16, 1981

[51] Int. Cl.[3] ..... D06M 3/02; D06M 3/12; D02G 2/00

[52] U.S. Cl. ..... 8/127.6; 8/128 R; 428/364

[58] Field of Search ..... 8/127.6, 128 R

[56] References Cited

U.S. PATENT DOCUMENTS 549,257 11/1895 Ris-Kummer ..... 8/127.6
2,220,805 11/1940 Pratt et al. ..... 8/127.6
3,479,128 11/1969 Borchert ..... 8/127.6
3,677,694 7/1972 Sugimoto et al. ..... 8/127.6

FOREIGN PATENT DOCUMENTS 49-506 1/1974 Japan ..... 8/127.6
290067 2/1971 U.S.S.R. ..... 8/128

*Primary Examiner*—Maria Parrish Tungol
*Attorney, Agent, or Firm*—Bill B. Berryhill

[57] ABSTRACT

Suture and prosthesis material comprising silk fibers the proteins of which have been crosslinked by fixing with a suitable fixative agent.

12 Claims, No Drawings

SUTURE AND PROSTHESIS MATERIAL

BACKGROUND OF THE INVENTION

1. Field of the Invention

The present invention pertains to suture and surgical prosthesis materials. In particular, it pertains to suture materials and fabrics suitable for production of vascular prosthesis.

2. Description of the Prior Art

Silk has been utilized for many years as a suture material. This material, sometimes called thread, braid, fiber, etc., is usually comprised of continuous strands of woven, braided or twisted discrete silk fibers or filaments of different fineness or denier. The number of silk filaments woven into each thread determines the size (diameter) and strength of the resultant thread. The silk filaments are of a fine continuous protein fiber produced by a variety of insect larvae. Most commonly, the material is a lustrous tough elastic fiber produced by silk worms and used for textile purposes.

The silk filaments are primarily composed of a protein known as silk fibroin. This protein comprises peptide chains crosslinked by hydrogen bonds and disulfide bonds, diester phosphate linkages and/or salt linkages. Thus, the silk molecule is composed of arrays of a nearly homogeneous protein that are arranged in a linear configuration, tenaciously crosslinked with hydrogen bonds between NH and CO groups to form a filament of sufficient strength for use as a thread component.

The silk filament can be fashioned into thread by twisting and the thread may in turn be fashioned into a fabric or cloth by weaving, felting or knitting. Such fabric has the potential to be fashioned into vascular prosthesis for use in animal recipients to replace occluded, damaged and/or diseased arteries and/or veins. The fabric may be fashioned into a variety of shapes by cutting and sewing using silk threads to join the pieces together. Thus, the formed device or prosthesis may be totally made of silk.

The protein of the silk thread, when used as a suture material or in a prosthesis, evokes or elicits an antibody reaction in the host tissue within a matter of weeks. The antibodies are probably produced and are directed against particular sites on the silk protein. The silk protein is a foreign protein in the host, thus becoming an effective antigen. Thus, silk thread which enjoys most of the physical qualities making it an ideal suture (easy to knot, flexibility, ease of handling, pliant, lacking stiff projecting ends when cut, easy to remove, etc.) suffers from its proteinaceous nature. It induces a host related cellular reaction. This cellular reaction is in all likelihood a true inflammatory reaction initially and evokes the migration of polymorphonuclear cells, lymphocytes and macrophages to the silk-tissue interface. The enzymatic reduction of the silk molecule is probably mediated by these cells. This may later pass into a true foreign body reaction with the macrophages attracting fibroblasts. Fibroblasts produce a collagenous capsule around the thread or prosthesis structure.

Enzymes produced by the macrophages slowly digest the silk in situ. After a period of one year in tissue, the silk material will have lost its tensile strength and in approximately two years will have disappeared completely.

In the case of skin sutures, the epidermis around the suture entry or exit points migrates down around the thread (suture tract). Thus, the suture itself becomes an irritant and the site of skin penetration becomes a wound. The removal of the silk suture ultimately leaves a scar. This is because the migrating epithelium produced at the wound margin migrates over the suture wound, meets and creates a small pit or dimple at each site. This can be prevented somewhat by removing the sutures early (sometimes before adequate wound strength has been attained).

If silk fabric is used as a vascular prosthesis material, its slowly absorbable nature will render the prosthesis unusable after a period of time, requiring its total replacement.

Thus, while silk, from the standpoint of flexibility, handling, etc. is ideal for sutures and a prosthesis material, its antigenicity and slowly absorbable nature, render it unsuitable for many applications. For this reason, other materials, lacking the flexibility, ease of handling, etc. of silk, are used for sutures and in the construction of vascular prosthesis.

SUMMARY OF THE INVENTION

Silk, of course, would be highly desired as a material for sutures and/or prosthesis if it did not evoke an antigen/antibody reaction in the host. It would especially be useful as a prosthesis material if it could effectively resist the enzymatic degradation mediated by the host leukocytes and macrophages. This would allow the silk prosthesis to serve as permanent structure. These problems of silk are eliminated in the present invention by altering the protein nature of the silk by chemical means.

In the present invention, the silk protein is effectively altered by fixing the silk in a fixing solution, e.g. dialdehydes, crosslinking the proteins thereof and covering or masking those immunologically recognizable sites of the silk molecule. A typical treatment would be the subjection of the silk, either prior to or after formation into threads or fabric, to a glutaraldehyde solution of sufficient concentration and for a period of time necessary for providing such crosslinking. Such crosslinking renders the silk proteins inert with respect to antigenicity, strengthens them, and contributes to their enhanced usefulness as a suture or prosthesis.

The crosslinked silk material of the present invention has most of the same qualities as untreated or silicone/-wax impregnated silk and is about ten percent stronger. It has no unusual storage requirements. It seems to be almost inert in the suture space evoking primarily a foreign body reaction and little or no antigen/antibody responses. It appears to resist enzymatic degradation of the host and/or pathogenic organisms that produce proteolytic enzymes. It poses no threat to the patient with respect to stability and/or as a possible foreign antigen. From the standpoint of prosthesis, the material as formed in the present invention is altered from a slowly absorbable to a permanent non-absorbable material. Many other advantages and objects of the invention will be apparent from the description which follows.

DESCRIPTION OF THE INVENTION

The improved silk material of the present invention is arrived at by subjection of the silk (either prior to or after formation into thread, fabric, etc.) to a fixative solution in a concentration and for a time sufficient to produce crosslinking of the proteins thereof. The period of time depends upon the concentration, the fixative volume, the silk volume or mass, temperatures, etc. Normally, the process will not require a buffered fixative solution although a buffer rendering the product compatible with life (e.g. bicarbonate, phosphate, barbitol, etc.) may be used at a concentration of 0.001 to 0.2 m with a pH range from 6.0 to 8.5.

It has been found that fixing agents selected from one or more of the dialdehyde group consisting of glutaraldehyde, glyoxal and hydroxyadipaldehyde are effective. For example, a glutaraldehyde solution ranging in concentration from 0.0001% to 50% (w/v or v/v) is workable. The stronger solutions require a fixation time of two or three hours and the weaker solutions requiring three to four weeks. Excessive fixation does not appear to affect the quality of the material.

After fixation, the silk may be thoroughly rinsed to remove the potentially toxic materials of the fixative solution or to reduce it to an acceptable human tolerance. Then the material could be air-dried or lyophilized. Alternately, it may be stored in hydrated form.

As an alternate method of treatment, the silk thread or fabric may be impregnated with another soluble protein (i.e. collagen gelatin, globulins, albumens, etc.) prior to chemical crosslinking. This may serve to increase the tensile strength, crosslinking and coating of the silk protein and to occlude the spaces between the individual filaments within each thread. The thread or fabric would otherwise be treated in the same fashion as described.

The fixing of the silk materials in these fixing agents will effectively crosslink all proteins therein and render the silk material inert with respect to antigenicity, resistant to enzymatic degradation, significantly strengthen and contribute to its enhanced usefulness as a suture material or a material for construction vascular prosthesis.

The suppression of the antigen/antibody reaction in the host accomplished by crosslinking appears to suppress the scar formation in the suture tract and makes silk thread an ideal non-absorbable and non-antigenic suture. The same qualities plus the non-absorbable nature of crosslinked silk fabric renders the material ideal for uses in the construction of strong, flexible and non-absorbable vascular prosthetics. The material is relatively inexpensive and presents no unusual storage requirements.

While several embodiments of the invention have been described herein, many variations thereof may be made without departing from the spirit of the invention. Accordingly, it is intended that the scope of the invention be limited only by the claims which follow.

I claim:

1. Material for suture and prosthesis comprising silk fibers, the proteins of which have been crosslinked by fixing in a dialdehyde fixative solution for a time sufficient to produce said crosslinking, said fixative solution including a fixative agent selected from one or more of the dialdehyde group consisting of glutaraldehyde, glyoxal and hydroxyadipaldehyde.

2. Material as set forth in claim 1 in which said fixative solution includes glutaraldehyde as the fixative agent.

3. Material as set forth in claim 1 in which said fixative solution is buffered with a buffer rendering said material compatible with life.

4. Material as set forth in claim 1 in which said silk fibers are impregnated, prior to said fixing in said fixing solution, with a soluble protein.

5. Material as set forth in claim 4 in which said soluble protein is selected from one or more of the group consisting of: collagen gelatin, globulins and albumens.

6. A method of treating silk suture threads an silk prosthesis fabric by fixing the silk in a dialdehyde fixative solution capable of crosslinking the proteins thereof, said fixative solution including a fixative agent selected from one or more of the dialdehyde group consisting of glutaraldehyde, glyoxal and hydroxyadipaldehyde.

7. The method of claim 6 in which said fixative solution includes glutaraldehyde as the fixative agent.

8. The method of claim 7 in which said fixative solution is buffered with a buffer rendering said silk compatible with life.

9. The method of claim 6 in which said silk is rinsed after said fixing until the concentration of potentially toxic material in said fixative solution is reduced to acceptable human tolerance.

10. The method of claim 9 in which said silk is dried for storage and later use.

11. The method of claim 6 in which said silk, prior to said fixing in said fixative solution, is impregnated with a soluble protein.

12. The method of claim 11 in which said soluble protein is selected from one or more of the group consisting of: collagen gelatin, globulins and albumens.

* * * * *